United States Patent [19]

Fine et al.

[11] 4,068,980

[45] Jan. 17, 1978

[54] COMPRESSOR STARTUP CONTROL

[75] Inventors: Gary J. Fine; Michael G. Herschler; John C. Shoop, all of Quincy, Ill.

[73] Assignee: Gardner-Denver Company, Dallas, Tex.

[21] Appl. No.: 728,703

[22] Filed: Oct. 1, 1976

[51] Int. Cl.[2] ..... F04B 49/02

[52] U.S. Cl. ..... 417/282; 417/27; 417/290; 417/295

[58] Field of Search ..... 417/12, 26, 27, 28, 417/290, 295

[56] References Cited

U.S. PATENT DOCUMENTS

| | | | |
|---|---|---|---|
| 2,172,751 | 9/1939 | Heinrich | 417/290 |
| 2,646,205 | 7/1953 | Rosenschold | 417/28 X |
| 3,424,370 | 1/1969 | Law | 415/1 |
| 3,602,610 | 8/1971 | Bloom | 417/295 X |
| 3,788,776 | 1/1974 | Post et al. | 417/295 |
| 3,860,363 | 1/1975 | Silvern et al. | 417/295 X |
| 3,961,862 | 6/1976 | Edstrom et al. | 417/295 X |

*Primary Examiner*—William L. Freeh
*Assistant Examiner*—Edward Look
*Attorney, Agent, or Firm*—Michael E. Martin

[57] ABSTRACT

A positive displacement gas compressor includes an inlet throttling valve which has an actuator responsive to a pressure fluid signal for closing the throttling valve. A control circuit for supplying pressure fluid to close the throttling valve includes a time delay device and a pilot operated valve which vents the pressure fluid signal holding the throttling valve closed after a predetermined time period commencing with startup of the compressor.

7 Claims, 1 Drawing Figure

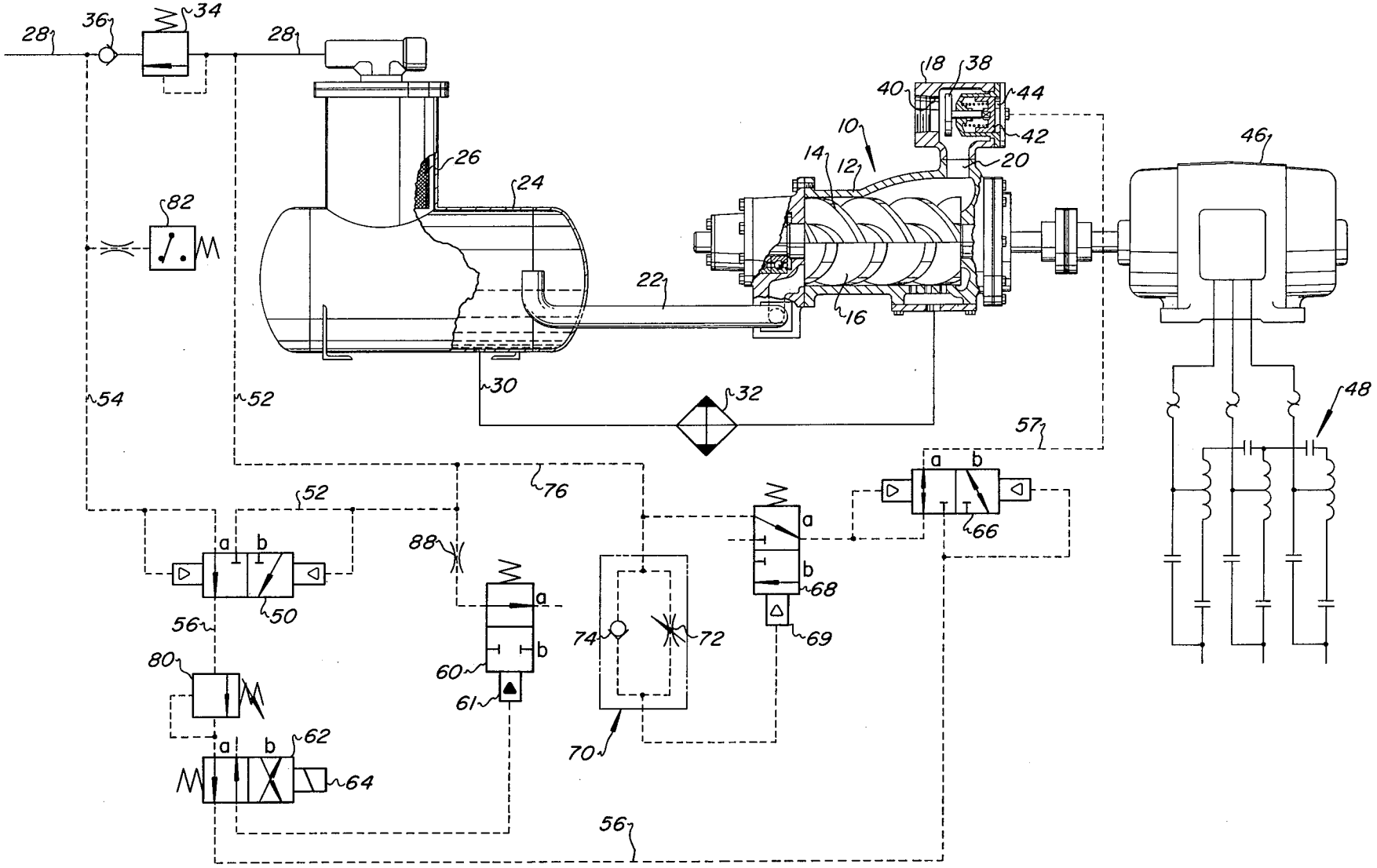
48
46
44
42
20
38
18
40
10
12
14
16
57
66
68
69
32
72
22
74
70
56
76
24
30
26
60
61
88
28
52
50
64
62
34
82
80
36
54
28

COMPRESSOR STARTUP CONTROL

BACKGROUND OF THE INVENTION

Positive displacement air and gas compressors, including helical screw and rotary vane types, require substantial starting torque if the compressor is started without throttling the inlet gas flow. Accordingly, compressors driven by electric motors require substantial current flow to start the compressor. However, limitation of starting current and voltage fluctuation can be important for energy conservation, and for many applications of electric motor driven compressors reduced voltage starters are therefore desirable. Reduced voltage starters provide for a gentle startup and smooth acceleration to running speed but limit the starting torque of the motor. Accordingly, it is desirable to provide automatic load control for the compressor to meet the starting torque capability of the motor.

SUMMARY OF THE INVENTION

The present invention provides a control system for a positive displacement gas compressor whereby compressor inlet gas flow is substantially throttled during compressor startup to thereby maintain the starting torque required at a relatively low value.

The present invention also provides a control system for a positive displacement gas compressor which operates to hold the compressor inlet gas throttling valve in a substantially closed condition for a predetermined time period.

The present invention further provides a startup control system for a gas compressor wherein a pressure fluid time delay device is operable to actuate a pilot operated valve to relieve a pressure fluid signal acting on the compressor inlet throttling valve after a predetermined time period which will allow a smooth startup of an electric motor driven compressor equipped with a reduced voltage starter or the like.

The control system of the present invention is also characterized by a control circuit which receives a pressure fluid signal generated by the compressor throughput at the onset of compressor startup which signal then operates to limit the starting torque requirement of the compressor to a relatively low value.

The present invention still further provides a control circuit which is operable to control the gas throughput as well as the startup torque demand of a positive displacement gas compressor wherein a pressure fluid signal for operating a fluid actuated inlet throttling valve may be provided from the compressor discharge gas receiver or from the compressed gas service conduit.

BRIEF DESCRIPTION OF THE DRAWING

The drawing illustrates a schematic diagram of a positive displacement gas compressor and startup control system in accordance with the present invention.

DESCRIPTION OF THE PREFERRED EMBODIMENT

Referring to the drawing a positive displacement gas compressor is illustrated and generally designated by the numeral 10. The compressor 10 is a liquid injected helical screw air compressor of a well known type and which is characterized by a casing 12 in which is disposed a pair of intermeshing helical screw rotors 14 and 16. The compressor 10 includes an inlet throttling valve

18 operable to substantially throttle the flow of inlet air to the compressor inlet port 20. The compressor 10 is operable in a known way to discharge a pressure air-liquid mixture through a conduit 22 to a compressed gas receiver and reservoir tank 24. A liquid separator 26 is disposed in the tank 24 for separating entrained liquid whereby substantially liquid-free compressed air may be conducted from the tank by way of a service conduit 28. A minimum pressure valve 34 and a one-way check valve 36 are desirably interposed in the service conduit 28. The conduit 28 leads to the plant air network or other user of compressed air, not shown. Liquid is recirculated back to the compressor 10 in a conventional manner by way of a conduit 30 and heat exchanger 32.

The inlet throttling valve 18 is characterized by a closure member 38 which is movable to close the inlet opening 40 to substantially throttle inlet air flow to the compressor. The closure member 38 is operable to be moved to the valve closed position by a pneumatic actuator comprising a piston 42 disposed in a chamber 44. The construction of the valve 18 is generally similar to the inlet throttling valve disclosed in U.S. Pat. No. 3,788,776 assigned to the assignee of this application.

The compressor 10 is driven by an electric motor generally designated by the numeral 46. The motor 46 illustrated may be a three-phase alternating current type induction motor and is adapted to be started by a reduced starting control device generally designated by the numeral 48. The starting device 48 illustrated is commonly known as an autotransformer starter although other types of reduced voltage starting devices may be used also. The starter 48 is adapted to be connected to a suitable electrical transmission line in a known way.

The compressor startup control circuit is illustrated in schematic form with graphic symbols for the circuit components. The condition or position of some of the valves shown are designated by the reference characters *a* and *b*. The control circuit is characterized by a pilot pressure fluid acutated shuttle valve 50. The valve 50 is adapted to actuated pressure fluid from the service conduit 28 by way of conduits 52 and 54 connected to the service conduit on the upstream and downstream sides of the check valve 36, respectively. The pilot pressure fluid actuators of the valve 50 are connected to the conduits 52 and 54 and are operable to actuate the valve 50 to provide pressure fluid to a conduit 56 from whichever conduit 52 or 54 is at the highest pressure condition.

A normally open two-position valve 60 is also connected to the conduit 52 for venting the reservoir tank 24 and the service conduit 28 upstream of the check valve 36. The conduit 56 has interposed therein a two-position, solenoid operated valve 62 which, when the solenoid actuator 64 is energized, places the pilot pressure fluid actuator of the valve 60 in communication with conduit 56 between the valves 50 and 62. When the solenoid actuator 64 is deenergized the valve 62 moves to vent the pilot actuator permitting valve 60 to open to vent the tank 24 and the compressor discharge conduit 22.

The conduit 56 leads to another two-position, pilot pressure fluid actuated valve 66 which is connected to the chamber 44 of the inlet throttling valve 18 by way of a conduit 57. The valve 66 operates as a shuttle valve to supply pressure fluid to or vent pressure fluid from the chamber 44 in accordance with the pressure condition in conduits 52 and 54 and the position of a pilot pressure fluid actuated valve 68. The valve 68 is operable in response to actuation by its pressure fluid operated actuator to vent the conduit 57 and the chamber 44 if the valve 66 is in position *a*. Moreover, the valve 62 is operable in its position *b* to vent the chamber 44 if valve 66 is in position *b*.

The valve 68 may be actuated to position *b* by its pilot actuator when a pressure signal of sufficient magnitude is generated by pressure fluid timing means generally designated by the numeral 70. The timing means 70 is characterized by an adjustable orifice 72 and a bypass check valve 74 interposed in a conduit 76 connected to the conduit 52. The valve 68 is operable in its position *a* to supply pressure fluid to chamber 44 to close the inlet throttling valve 38, provided pressure fluid at sufficient pressure is available in conduit 52. The valve 18 is designed to be closed at a relatively low pressure condition in the chamber 44. For example, an air compressor designed to compress air from atmospheric pressure to a discharge gage pressure of from 700 to 1050 Kpa may require only 105 Kpa to close the inlet throttling valve 18. The actuator for the inlet throttling valve 18 may be modified to operate to close the valve at other pressures, however. Accordingly, a pressure reducing valve 80 is interposed in conduit 56 to reduce the control pressure therein to the value required to hold the valve 18 in the closed position.

The control circuit of the present invention also includes a pressure responsive switch 82 operable to sense the pressure in conduit 54 and adapted by suitable electrical circuitry, not shown, to deenergize the solenoid actuator 64 as a result of fluid pressure in the service conduit 28 increasing above a predetermined set point downstream of the check valve 36. The switch 82 is also adapted to close on decreasing pressure below a predetermined minimum set point thereby energizing the solenoid actuator 64 to move the valve 62 to position *b*. The pressures which operate to open and close the switch 82 are normally set to be, respectively, the maximum and minimum desired working pressures in the service conduit 28. The switch 82 is adapted to be disposed in a suitable control circuit so as to be operable to initiate the operation of the reduced voltage starter 48 when the pressure in the conduits 28 and 54 drops below the minimum set point and to cause the motor 46 to be deenergized when the pressure increases to the maximum predetermined set point. The electrical circuit for operating the starter 48 might also include a manual or other type of switch in circuit with the switch 82 to provide for independent control of the starting and stopping of the compressor motor. The electrical circuitry for initiating operation of the starter 48 and including the switch 82 may be of various conventional embodiments and will be understood to be well known to those skilled in the art of compressor controls.

Reduced voltage starters including the autotransformer starter 48 require finite time intervals for accelerating the motor and driven load and for switching from the reduced starting voltage to line voltage. Therefore, it is desirable to limit the torque required by the compressor during starting until the compressor has substantially reached running speed and the starter has switched to full line voltage. Since the compressor starting torque requirement is related to the pressure developed by the compressor on the working fluid the gas throughput may be throttled on startup to limit the starting torque. The compressed gas receiver tank may also be sized to prevent the rapid buildup of pressure downstream of the compressor during startup. However, limits on the pratical size of the receiver tank preclude the reliance on such an arrangement alone as the load limiting control for compressor startup. Discharge gas blowoff may be used as a load limiting control on some types of compressors but for liquid injected positive displacement compressors and, particularly, helical screw types it has been determined that control of inlet gas flow is the most effective and desirable method of controlling compressor starting torque.

In the operation of the control system of the present invention it may be assumed as one condition of the compressor that the service conduit 28 is not pressurized on either side of the check valve 36. Accordingly, the switch 82 would be in the closed position. Valves 50 and 66 may be in their respective positions *a* or *b* and valves 60 and 68 would both be in their positions *a*. Without any pressure in chamber 44 the closure member 38 would be free to open in response to compressor startup. As soon as a manual start switch, not shown, is closed the switch 82 would be energized to supply current to solenoid 64 and move valve 62 to position *b*. The starter 48 would also be operated by its own control circuit, not shown, to commence a sequence of switching operations to initially energize the motor 46 at reduced voltage. As soon as the rotors 14 and 16 commence rotation to displace working fluid the pressure will begin to increase in the tank 24 due to the minimum pressure valve 34 and the limited size of the conduit leading to the valve 60 as indicated by the orifice 88. The valve 60 itself might be limited in size to prevent unrestricted fluid discharge from the tank 24. Accordingly, as soon as fluid pressure in tank 24 begins to increase the valve 50 shifts to position *b* to supply pressure fluid to the actuator 61 to move valve 60 to position *b*. Valve 68, in position *a*, also supplies pressure fluid to shift valve 66 to position *a* whereby pressure fluid also flows to the chamber 44 of the inlet throttling valve 18. As soon as the pressure in chamber 44 increases sufficiently to close valve 18 the compressor gas throughput is substantially throttled and the compressor continues to accelerate to operating speed with low torque requirements.

The fluid pressure sufficient to close the valve 18, for example about 105 Kpa gage pressure, is also sufficient to shift valve 68 to position *b* by its own pressure fluid actuator 69 and whereby the chamber 44 may then be vented to allow the throttling valve to open. The valve 68 is shifted to position *b* after a time delay determined by the timing means 70. The pressure increase sufficient to cause the actuator 69 to operate to move the valve 68 to position *b* may be controlled by the adjustable orifice 72 of the timing means 70 and, accordingly, opening of the throttling valve 18 may be delayed in accordance with the time interval required for operation of the starter 48 to bring the compressor and motor up to operating speed.

The compressor 10, once up to speed and operating on full line voltage supplied to the motor 46 will supply pressure gas to the service conduit 28 until the pressure in the conduit reaches the condition which will cause switch 82 to open to deenergize the solenoid 64 allowing valve 62 to move to position *a*. The switch 82 is also in circuit with suitable means, not shown, for opening the line contacts to the motor 46 whereby the compressor will be shut down. When valve 62 is moved to position *a* the actuator 61 is vented and valve 60 moves to position *a* to vent tank 24. Valve 50 will move to position *a* and supply pressure fluid at a reduced pressure through valve 62, in position *a*, and valve 66, after shifting to position *b*, to the chamber 44 to close the inlet throttling valve 18.

When the pressure in the service conduit 28 drops to a value sufficient to close the switch 82 the valve 62 will shift to position *b* to vent chamber 44. Valve 62 in position *b* will also supply pressure fluid to the actuator of the valve 60 to move that valve to position *b*. Closing of switch 82 will also energize the control for the starter 48 and the compressor will start under substantially the same operating condition as described hereinbefore. Accordingly, regardless of the pressure condition of the service line 28 downstream of the check valve 36 for any pressure less than the minimum pressure set point for the switch 82 the control system of the present invention will operate to provide for starting the compressor at relatively low torque requirement.

What is claimed is:

1. In a control system for a gas compressor including a positive displacement gas compressor, a motor drivably connected to said compressor, an inlet throttling valve operable to be open to admit inlet gas to said compressor upon commencement of starting of said compressor and including a pressure fluid actuator for closing said throttling valve, compressed gas receiver means connected to said compressor, a compressed gas service conduit connected to said receiver means for conducting compressed gas from said receiver means, and a check valve interposed in said service conduit and operable to prevent the back flow of compressed gas from said service conduit to said receiver means, the improvement characterized by:

first conduit means in communication with said receiver means for conducting a pressure fluid signal to said actuator to close said throttling valve in response to increasing pressure in said receiver means upon starting said compressor;

a normally open control valve interposed in said first conduit means, said control valve being pressure fluid actuated to interrupt said pressure fluid signal to said throttling valve, a pressure fluid timer in communication with said first conduit means for receiving a pressure fluid signal therefrom and for actuating said control valve to interrupt said pressure fluid signal to said actuator at the expiration of a predetermined time period to allow said throttling valve to reopen;

second conduit means in communication with said service conduit downstream of said check valve in regard to the normal flow of compressed gas; and, a first shuttle valve connected to said first conduit means and said second conduit means and responsive to the greater of the pressure signals in said respective conduit means to conduct said greater pressure signal to said actuator for closing said inlet throttling valve.

2. The invention set forth in claim 1 wherein:

said control system includes a solenoid operated valve interposed in said second conduit means and operable to interrupt a pressure fluid signal from said service conduit and vent said second conduit means between said solenoid operated valve and said first shuttle valve.

3. The invention set forth in claim 2 wherein:

said control system includes a pressure actuated switch responsive to a first predetermined pressure in said service conduit for causing said solenoid operated valve to conduct pressure fluid to said first shuttle valve, and said switch is responsive to a second predetermined pressure in said service conduit which is less than said first predetermined pressure for causing said solenoid operated valve to vent pressure fluid from said second conduit means.

4. The invention set forth in claim 3 together with:

a pressure release valve adapted to release the fluid pressure in said receiver means in response to the operation of said switch to cause said solenoid operated valve to conduct pressure fluid to said first shuttle valve.

5. The invention set forth in claim 4 wherein:

said pressure release valve includes actuator means adapted to close said pressure release valve by a pressure fluid signal from said solenoid operated valve.

6. The invention set forth in claim 5 together with:

a minimum pressure valve in said service conduit downstream of said receiver means and a second shuttle valve adapted to conduct pressure fluid to said solenoid operated valve from said service conduit on the upstream side or the downstream side of said minimum pressure valve whichever side the pressure is the greater.

7. In a control system for a gas compressor including a positive displacement gas compressor, a motor drivably connected to said compressor, an inlet throttling valve operable to be open to admit inlet gas to said compressor upon commencement of starting of said compressor and including a pressure fluid actuator for closing said throttling valve, compressed gas receiver means connected to said compressor, a compressed gas service conduit connected to said receiver means for conducting compressed gas from said receiver means, and a check valve interposed in said service conduit and operable to prevent the back flow of compressed gas from said service conduit to said receiver means, the improvement characterized by:

first conduit means in communication with said receiver means for conducting a pressure fluid signal to said actuator to close said throttling valve in response to increasing pressure in said receiver means upon starting said compressor;

a control valve interposed in said first conduit means, said control valve being operable to interrupt said pressure fluid signal to said throttling valve, timing means for operating said control valve to interrupt said pressure fluid signal to said actuator at the expiration of a predetermined time period to allow said throttling valve to reopen;

second conduit means in communication with said service conduit downstream of said check valve in regard to the normal flow of compressed gas; and, a first shuttle valve connected to said first conduit means and said second conduit means and responsive to the greater of the pressure signals in said respective conduit means to conduct said greater pressure signal to said actuator for closing said inlet throttling valve.

* * * * *